United States Patent [19]

Nistri et al.

[11] Patent Number: 4,583,698

[45] Date of Patent: Apr. 22, 1986

[54] WEB-WINDING MACHINE FOR WINDING PAPER WEBS ONTO CARDBOARD CORES OR THE LIKE

[75] Inventors: Ugo Nistri; Romano Baroffio; Giuseppe Ghisu, all of Genoa, Italy

[73] Assignee: Mira Lanza s.p.a., Genoa, Italy

[21] Appl. No.: 610,088

[22] Filed: May 9, 1984

[30] Foreign Application Priority Data

Sep. 26, 1983 [IT] Italy ..... 12630 A/83

[51] Int. Cl.[4] ..... B65H 19/20

[52] U.S. Cl. ..... 242/56 R; 242/56 A; 242/64; 198/803.12

[58] Field of Search ..... 242/56 A, 56 R, 55.1, 242/67.1 R, 67.3, 64, 67.2, 68.4, 73, 75.51; 198/651, 627

[56] References Cited

U.S. PATENT DOCUMENTS

| | | | |
|---|---|---|---|
| Re. 28,353 | 3/1975 | Nystrand et al. | 242/56 A |
| 1,195,721 | 8/1916 | Post | 198/627 X |
| 2,968,448 | 1/1961 | Drum | 242/55.1 |
| 3,031,152 | 4/1962 | Cohen et al. | 242/75.51 |
| 3,123,315 | 3/1964 | Couzens | 242/56 A |
| 3,315,908 | 5/1965 | Wetzler | 242/55.1 X |
| 3,430,881 | 3/1969 | Ebneter | 242/56 A |
| 3,791,603 | 2/1974 | Lenius | 242/56 A |
| 4,056,918 | 11/1977 | Matsumoto | 242/56 A |
| 4,191,341 | 3/1980 | Looser | 242/56 A |
| 4,283,023 | 8/1981 | Braun et al. | 242/67.1 R |
| 4,339,092 | 7/1982 | Benoy et al. | 242/56 R |

*Primary Examiner*—Stephen Marcus
*Assistant Examiner*—Leo Peters
*Attorney, Agent, or Firm*—Spencer & Frank

[57] ABSTRACT

The continuous paper web, unwound from a feeding roll, is first passed through a perforation station to generate pre-established tear-off lines and then through a severing station where it is severed into sheets of the desired length. From the severing station, the web is advanced to the winding station, to which the cardboard cores supported at their ends by two idle mandrels are also supplied. The winding station is defined by two endless belts diverging from each other in the direction of the outlet from this station and moved at different speeds. At the inlet of the winding station, the cardboard cores are rotated by said belts, whereby the length of paper web advanced to said station by the lower belt is wound onto one of said cores. The so-formed roll is transferred to a discharge station, where it is released by disengaging the mandrels from the ends thereof. The two free mandrels are then transferred to a loading station where they pick up a new cardboard core.

15 Claims, 3 Drawing Figures

17
11
13
212
312
16
12
14
510
10
410
111
409
310
110
309
9
V2
210
209
112
V0
15
509
PS
M3
CV
5
6
206
7
207
4
102
106
107
8
V1
609
102'
M1
3
103
109
2
201
1
101
M2
CD 15
112
112
412
412
412
412
512
512
12
12
12
12
612
612
612
612
13
13
613
613
11
F
213
213
313
313
513
513
713
713
712
712
413
413
113
113
14
14

WEB-WINDING MACHINE FOR WINDING PAPER WEBS ONTO CARDBOARD CORES OR THE LIKE

BACKGROUND OF THE INVENTION

This invention relates to the winding machines forming small-diameter paper rolls, or the like, on a core of cardboard or the like, and supplied from a greater-diameter roll. The thus-formed rolls are then divided further to form paper rolls, such as toilet tissue rolls, paper toweling rolls, or the like.

Winding machines of this type are known, for example, from the U.S. Pat. No. Re. 28353 issued on Mar. 4, 1975.

In these known machines, the cardboard core whereon the paper web is wound to form the roll is threaded on a metal mandrel throughout its length.

In these known machines, the threading and unthreading of said core on the mandrel involves time-consuming operations which negatively affect the overall operating speed of the machine. Moreover, these operations require the use of special provisions.

SUMMARY OF THE INVENTION

Therefore, the main object of this invention is to provide a high-speed winding machine provided with means permitting an easy loading of the cores whereround the paper web is to be wound, and unloading of the rolls formed on said cores, said means enabling the machine to operate continuously with no downtime.

A further object of this invention is to provide a machine of the above type, comprising a web-unwinding station; a web-perforation station whereat perforation is effected at regular intervals at tear-off lines on the web; a cut-off station whereat the continuous web is servered into sheets of the desired length for the final rolls; a transfer station for transferring said sheets onto an endless conveyor belt and a winding station whereat each sheet is wound onto a cardboard core which has been fed to said station, said winding station being defined at the bottom by a portion of said endless conveyor belt, and at the top by an endless counter-belt moving in a direction opposite to that of the conveyor belt, and kept in contact with the roll being formed during the entire step of formation thereof, so as to act on said roll in a balanced manner at two diametrically opposite positions.

Advantageously, the speeds of travel of the conveyor belt and counter-belt are slightly different so as to advance the roll being formed, at an exactly-controlled speed, through the winding station.

BRIEF DESCRIPTION OF THE DRAWINGS

Further characteristics and advantages of the winding machine according to the invention will be more apparent from the following detailed description thereof, made with reference to the accompanying drawings, wherein.

DESCRIPTION OF THE PREFERRED EMBODIMENT OF THE INVENTION

Figure 1:
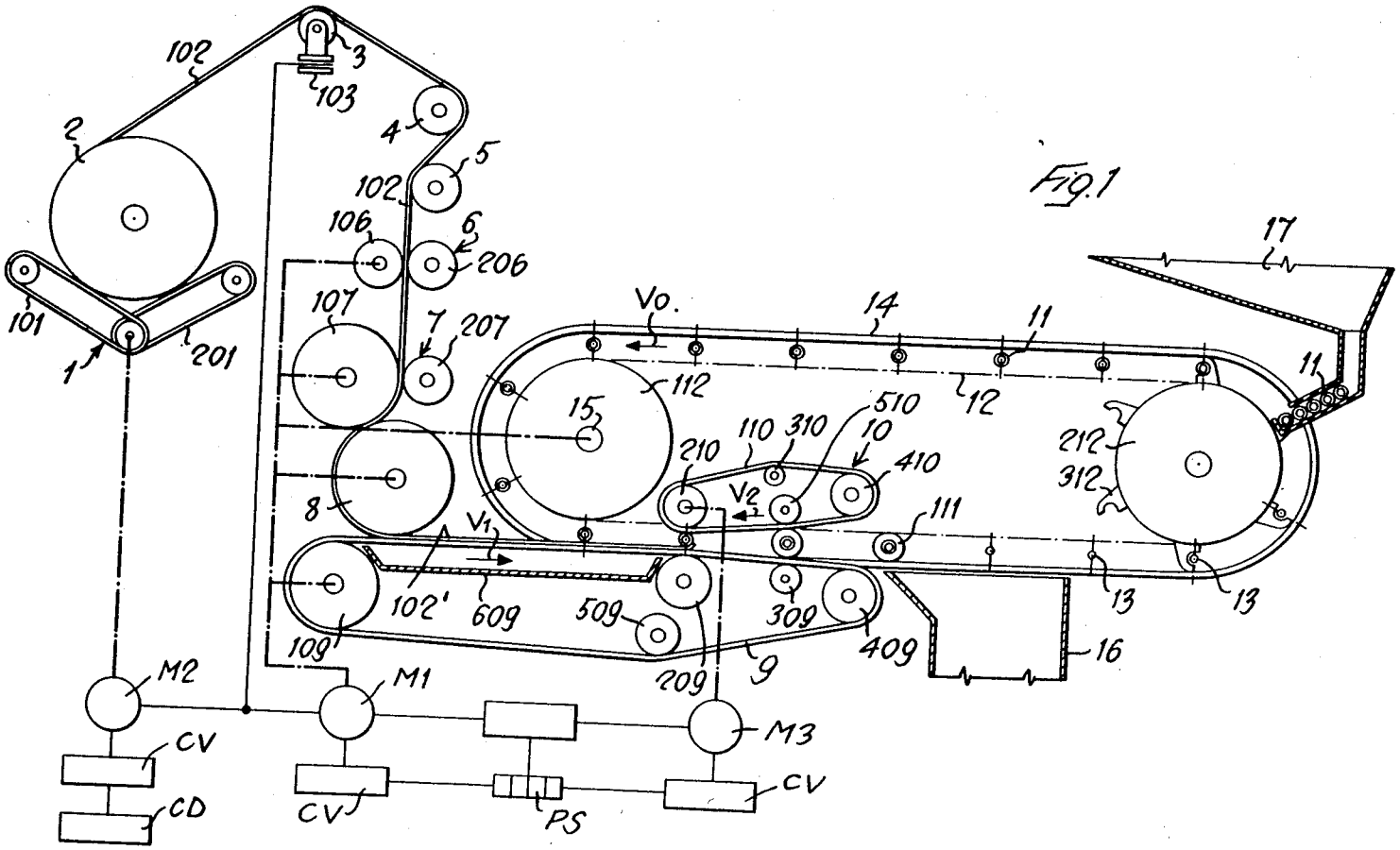
FIG. 1 is a diagrammatic general view of the machine according to the invention, with a block diagram of the control circuit therefor.

With reference to the drawings, and particularly to the FIG. 1 thereof, the machine shown therein comprises a paper web feeding station 1. This station comprises two sets of endless belts 101 and 201, arranged in a "V" configuration, actuated by the motor M2 as described hereinafter, supporting the parent roll 2 which supplies the paper web 102. The web 102 is passed over a roller 3 which is associated with a load cell 103 for the purposes specified hereinafter. Past the roller 3, the web 102 reaches, through a series of idle rollers 4 and 5, the perforation station 6. The perforation station 6 comprises, in a manner which is known per se, a roller 106 provided with rows of punching or perforating pins, and a counter-roller 206 co-operating with the roller 106 to form a series of regularly-spaced rows of perforations on the web 102. The rollers 106 and 206 are actuated by the motor M1 as described hereinafter.

Past the perforation station 6, the web reaches the cut-off station 7, comprising a cut-off roller 107 and a counter-roller 207. The cut-off roller 107 comprises a cutting blade (not shown) co-operating with a counter-blade (not shown) carried by the counter-roller 207, to sever the web 102 into stretches of a desired length for the rolls to be wound. The cutting blade is normally accommodated within the roller 107, and is extended outwardly to a cutting position after a given number n of rotations of said roller, depending upon the desired length of the sheets of web to be formed. The extension of the cutting blade to the operative position thereof may be effected, for example, by pneumatic means or by any other suitable means. The sheet of cut-off web 102' is transferred, by means of the transfer roller 8, onto the endless belt 9. Both the roller 107 and roller 8 may be provided with pneumatic means to transfer the leading end of the web 102, and to retain the tail end of the sheet of web 102', from one roller to another roller and to the endless belt 9. Alternatively, means may be provided to clamp the leading end of the belt 102 mechanically, said means being activated simultaneously with the cutting blade to transfer said leading end onto the roller 8. The endless belt 9 is passed over the rollers 109, 209, 309, 409 and 509, the roller 109 being actuated by the motor M1 that also actuates the rollers 8, 107 and 106 as stated above.

The upper portion of the belt 9 extends from the transfer roller 8 to a position below the winding station 10. The belt 9 is perforated and its upper portion, extending from the point of tangency with the roller 8 to the inlet of the winding station, communicates with a suction manifold 609. The winding station 10 comprises a second endless belt 110 passed over the rollers 210, 310, 410 and 510, the roller 210 being actuated by the motor M3. The lower portion of the belt 110 is located above the tail portion of the upper portion of the belt 9, and its plane diverges from the plane of the belt 9, from the inlet to the outlet of the winding station, to such an extent that the spacing between said belts corresponds, at the inlet of said station (defined by the rollers 210 and 209), to the diameter of the core for the roll to be formed, while, at the outlet of said station (defined by the rollers 510 and 309), said spacing corresponds to the final diameter of the roll produced by the machine.

After describing the feeding of the paper web to the winding station, the feeding will now be described of the cardboard core 11 to said station.

The numeral 12 indicates a suspension chain, passed over the sprocket wheels 112 and 212. The wheel 112 is actuated by the motor M1, while the wheel 212 is provided with a series of radially-protruding hooks 312 for grasping the cores 11, as described hereinafter. The chain 12 has suspended therefrom the mandrels 13 designed to engage the cores 11, said mandrels being provided with a projection which is engaged and guided by a guide member 14 arranged parallel to the chain 12.

Figure 2:
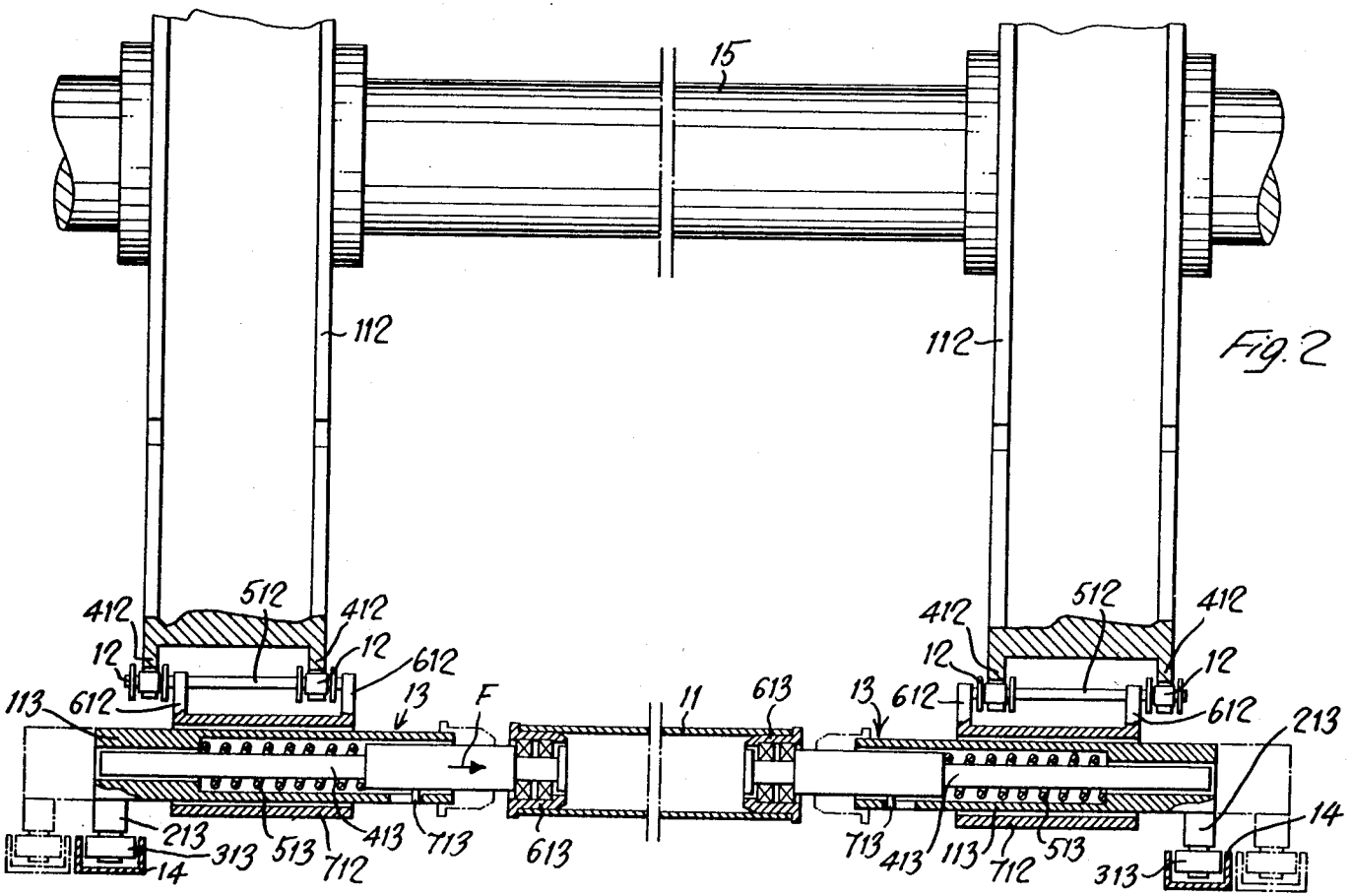
FIG. 2 is a fragmentary view of the suspension and translation system for the mandrels designed to support the cardboard cores, some portions being shown in sectional view.

With particular reference to FIG. 2 of the drawings, the mandrels 13 and their suspension and guide system will now be described.

The shaft 15 mounts, at the ends thereof, the sprocket wheels 112 having a pair of gear rings 412 each meshing with the links of a pair of twin chains 12 which are connected to each other by spindles 512. Said spindles 512 have suspended therefrom at a suitable spacing, through lugs 612, the sleeves 712 designed to support the mandrels 13. Each mandrel 13 comprises a tubular body member 113 which is mounted so as to be axially slidable, but not rotatable, in the sleeves 712, and which is provided at an end thereof with a radial projection 213 carrying a roller 313 engaged with the guide members 14. Axially slidable within the body member 113 is a rod 413 which is constantly urged in the direction of the arrow F by the action of a spring 513 arranged between a shoulder on the rod 413 and a shoulder on the body member 113. A head member 613 is freely rotatably mounted at the end of a rod 413.

Figure 3:
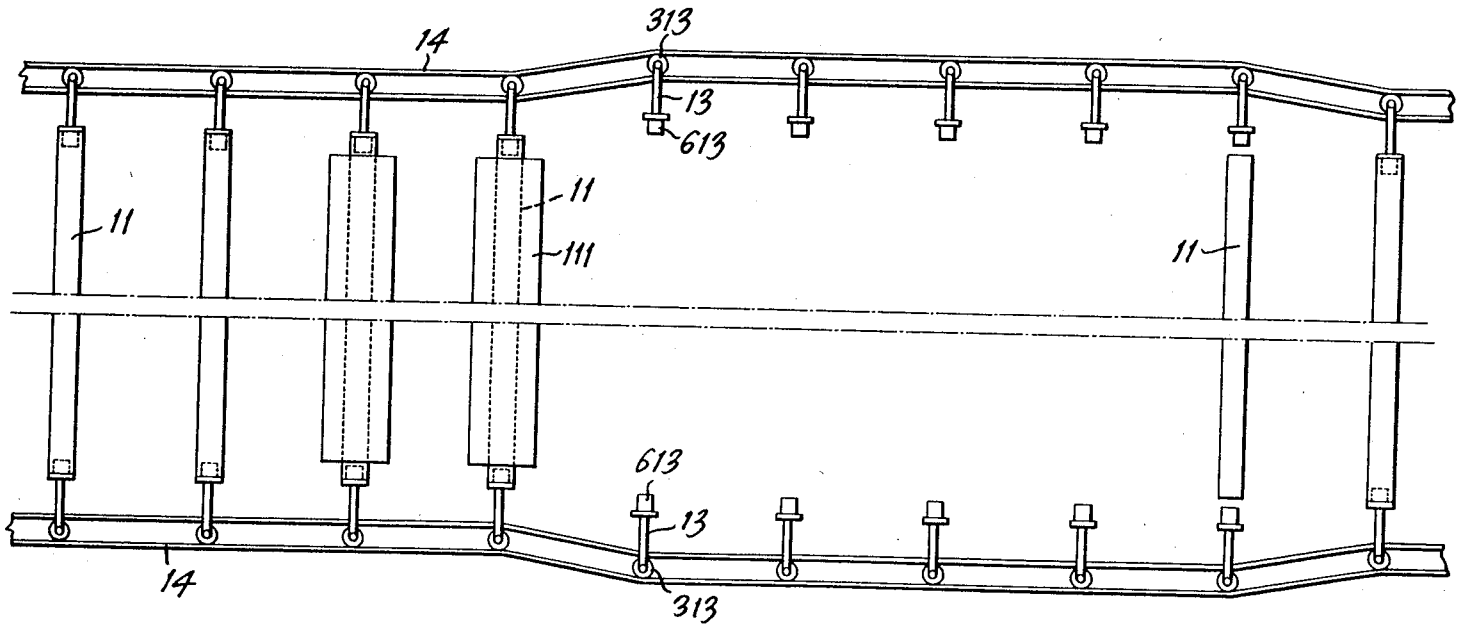
FIG. 3 is a diagrammatic plan view of a detail of the control system for opening and closing the core-supporting mandrels.

A pin 713 carried by the rod 413, in co-operation with a slot formed in the body member 113, limits the axial displacement of the rod 413 with respect to the body member 113. As shown in FIG. 3, the spacing between the guide members 14 is increased at the discharge hopper 16 for the final rolls, and is reduced again downstream of the station 17 where the cores 11 are fed, thus causing the movement to and from each other, respectively, of the facing pairs of mandrels 13.

The device described above operates as follows:

With reference to FIG. 1, the motor M1 actuating the perforator unit 6, the cut-off unit 7, the transfer roller 8 and the lower belt 9, is a pilot motor for the motors M2 and M3.

Specifically, the load cell 103 regulates the speed ratio between M1 and M2 to maintain a constant tension on the web 102.

Specifically, if

Vo=speed of advance of cores 11

V1=speed of belt 9

V2=speed of belt 110

L=length of sheet 102' to be rewound

P=spacing between two cores 11 on the mandrels 13, and

T1=time to rewind L, and assuming V1>V2 the equation of the operation of the described machine is $$Vo = V1 - V2 \quad (1)$$

This relation is obtained by means of a pre-setter PS which constantly maintains the speed V2 from the motor M3 lower than the speed V1 from the motor M1.

The calibration of the pre-setter PS is effected on the basis of the following equations:

$$T1 = L/V1;\ Vo = P/T1 = PV1/L$$

By substituting Vo in the equation (1), the following equation is obtained:

$$V2 = V1\left(1 - \frac{P}{L}\right)$$

The speed Vo is mechanically taken off the motor M1 and is controlled by a suitable electronic system to maintain a constant incoming position of the cores with respect to the leading end of the web to be wound, at the winding station 10.

Suitable converter circuits CV control the motors M1, M2 and M3 as a function, respectively, of the pulses from the pre-setter PS and the device CV which controls the diameter of the parent roll 2.

The operation of the machine is now apparent. The web 102 unwound from the roll 2 is passed through the perforation station 6, where it is perforated to form the tear-off lines. The perforated web is then passed through the cut-off station 7 where it is severed at regular intervals into sheets 102' of pre-established length, which are transferred onto the belt 9 and then to the winding station 10, simultaneously with a cardboard core 11 supported by two mandrels 13. At the station 10, the rotation of the core 11 is started and, simultaneously, the sheet of web 102' is wound onto said core by the combined effects of the webs 9 and 110. In order to promote the adhesion of the web 102' to the core wherearound it is to be wound, a stripe of glue may be applied on said core 11 by a glueing roller (not shown) located upstream of the winding station, or the leading end of the web 102' may be adhered to the core 11 by means of a suitably-directed air jet. The winding of the sheet of web 102' onto the core 11 goes on while the roll is being formed between the belt 9 and counter-belt 110, and on completion of this operation the thus-formed roll 111 is transferred, between the mandrels 13, to the discharge station 16. At this station, the guides 14 diverge from each other, whereby through the projections 213 of the mandrels 13 the spacing between the heads 613 of the mandrels is increased to such an extent as to become greater than the length of the cores 11, so that the rolls 111 formed on said cores fall, by the action of gravity, into the hopper 16 of the discharge station.

The mandrels 13 continue advancing under the action of the chain 12, to the feeding station 17 where the new cores 11 are supplied therebetween. At this station, the cores 11 are picked up one by one by the hooks 312, while the mandrels 13, under the action of the guides 14, will be moved again toward each other to penetrate again into the ends of the cores 11 and will carry them again to the winding station 10, thus completing the operative cycle.

Of course, the invention is not limited to the preferred embodiment herein shown and described by way of a nonlimitating example, but it comprises all the changes and modifications within the broadest scope of the inventive principle, substantially as claimed hereinafter.

What we claim is:

1. A web-winding machine for winding paper webs onto cardboard cores or the like supported only at both ends, comprising:

a station (1) for supplying the continuous paper web (102);

a perforation station (6) for perforating said continuous web and creating pre-established tear-off lines;

a station (7) for severing the continuous perforated web into sheets (102') of pre-established length to be wound;

transfer means (8) for conveying said sheets of web to a winding station (10); and feeding means (12-13) to supply a tubular cardboard core (11) to said winding station (10) in synchronism with each of said sheets (102') of paper web, wherein said winding station (10) includes a first conveyor belt (9) having an upper portion which is substantially co-planar with said sheets (102') of paper web, and rotating in the feeding direction of said sheets of paper web, a secondary conveyor belt (110) the lower portion of which is located above the upper portion of said first conveyor belt (9) and moves in the opposite direction with respect to the feeding direction of said sheets of paper web, the spacing between the upper portion of the first conveyor belt (9) and the lower portion of the second conveyor belt (110) being such that at the inlet of said station it corresponds substantially to the diameter of the cardboard core (11), while at the outlet of said station it corresponds substantially to the diameter of the final roll (111), said first (9) and second (110) conveyor belts being moved at different speeds such that, assuming Vo is the advancing speed of the cardboard cores (11), V1 the speed of the lower portion and V2 the speed of the upper portion, the following equation will be true:

$$Vo = V1 - V2,$$

wherein said feeding means for the cardboard cores comprises an endless conveyor means (12) moving from a station (17) supplying the cardboard cores (11), through said winding station (10) to a station (16) for discharging the completed rolls (111) and then moves back to said station (17) supplying the cardboard cores (11), means associated with said conveyor means (12) and constituted by a plurality of pairs of mandrels (13) comprising heads (613) adapted to penetrate into the ends of said tubular cardboard cores (11) at said supplying station (17), and to support said cores in a freely rotatable manner to said discharge station (16), where said mandrels (13) are removed from the ends of the cores of the completed rolls (111), thereby permitting the rolls to be discharged, and means (14) to control the axial movement of the heads (613) of the supporting mandrels (13) into and out of the ends of said cores (11), and wherein said mandrels (13) are actuated mechanically and comprise each a tubular support (712), a tubular body member (113) which is mounted so as to axially slidable but not rotatable in said tubular support (712), a rod (413) which is mounted so as to be axially slidable but not rotatable in said tubular body member (113), a mandrel head (613) rotatably mounted on the end of said rod (413), spring means (513) arranged between said rod (413) and said tubular body member (113) to urge said rod (413) constantly so as to engage the head (613) of the mandrel into the hollow end of the tubular cores (11), detent means (713) between said rod and said tubular body to limit the axial movement of said rod, and cam (14)/cam follower (313) means associated with said tubular body member (113) to cause the axial movement of said tubular body member (113) in a direction to engage said tubular cores (11) or in a direction to disengage said tubular cores (11), respectively.

2. A web-winding machine according to claim 1, wherein said conveyor means for the mandrels comprises a chain conveyor (12), said tubular supports (712) for the mandrels (13) being suspended from said chains (12), and wherein said cam (14)/cam follower (313) means comprises a radial projection (213) solidary with the tubular body (113) of the mandrels (13) and provided with an idle roller (313) at the end thereof, and a profiled guide (14) which follows the path of travel of said conveyor and which is engaged by said idle roller (313) to roll therealong.

3. A machine according to claim 1, wherein said perforation station (6) comprises a perforator roll (106) and respective counter-roller (206).

4. A web-winding machine according to claim 1, wherein positioning means (312) are provided at the cardboard cores feeding station (17), for grasping said cores (11) and supporting them temporarily and carrying them to such a position as to permit the introduction of the heads (613) of the supporting mandrels (13) thereinto.

5. A web-winding machine according to claim 4, wherein said positioning means (312) are in the form of a series of pairs of hooks or cradles protruding radially from a sprocket wheel (212) of the endless conveyor (12) for the mandrels (13) which is located at the loading end of the conveyor (12).

6. A web-winding machine according to claim 1, wherein the perforation station (6), the cut-off station (7), the transfer means (8) and the first conveyor belt (9) are operated by a single motor M1 which acts as a pilot motor with respect to a motor M2 for actuating the paper web feeding station (1) and a motor M3 for actuating the second conveyor belt (110) for the winding station (10), a load cell (103) being provided which is responsive to the tension of the web (102) coming from the feeding station (1) to regulate the speed ratio between the motor (M2) of said station and the pilot motor (M1) so that the web (102) is maintained at a constant tension.

7. A web-winding machine according to claim 6, wherein an electrical control circuit is provided for said machine and a pre-setter (PS) is inserted in the electrical control circuit to maintain the speed V2 imparted from the motor (M3) actuating the winding station always lower than the speed V1 imparted from the pilot motor (M1) and such that $$V2 = V1\left(1 - \frac{P}{L}\right)$$

wherein P is the spacing between the cardboard cores, and L is the length of the web to be rewound.

8. A web-winding machine according to claim 1, wherein said cut-off station (7) comprises a roller (107) provided with a retractable cut-off blade, and a counter-roller (207), said cut-off roller (107) being provided with means for grasping the leading end of the severed web to transfer it to the next station.

9. A machine according to claim 8, wherein said grasping means is of mechanical nature and is acutated synchronously with the cut-off blade.

10. A web-winding machine according to claim 8, wherein said grasping means is of pneumatical nature.

11. A web-winding machine according to claim 1, wherein said transfer means comprises a transfer station (8) for the severed sheets of the web from the cut-off station (7) to the winding station (10).

12. A machine according to claim 11, wherein said transfer station comprises a transfer roller (8) co-operating with a transfe belt (9).

13. A machine according to claim 12, wherein said transfer belt (9) and transfer roller 8 are of the suction type.

14. A machine according to claim 13, wherein said transfer belt (9) is formed by a portion of the first conveyor belt of the winding station.

15. A machine according to claim 12, wherein said transfer belt (9) is formed by a portion of the first conveyor belt of the winding station.

* * * * *